US011673708B2

(12) United States Patent
Southwell

(10) Patent No.: US 11,673,708 B2
(45) Date of Patent: Jun. 13, 2023

(54) SINGLE-PIECE PACKAGE TO CONTAIN AND PROTECT PRODUCT

(71) Applicant: Packaging Corporation of America, Lake Forest, IL (US)

(72) Inventor: James D. Southwell, Long Grove, IL (US)

( * ) Notice: Subject to any disclaimer, the term of this patent is extended or adjusted under 35 U.S.C. 154(b) by 0 days.

(21) Appl. No.: 17/317,098

(22) Filed: May 11, 2021

(65) Prior Publication Data

US 2021/0347523 A1 Nov. 11, 2021

Related U.S. Application Data

(60) Provisional application No. 63/023,161, filed on May 11, 2020.

(51) Int. Cl.
*B65D 5/50* (2006.01)
*B65D 5/22* (2006.01)

(52) U.S. Cl.
CPC ..... *B65D 5/5021* (2013.01); *B65D 5/22* (2013.01)

(58) Field of Classification Search
CPC ..... B65D 5/522; B65D 5/5021; B65D 81/07; B65D 81/075; B65D 25/10; B65D 25/102; B65D 5/5078
USPC ..... 229/939, 122.32, 103.11; 428/34.2; 206/583
See application file for complete search history.

(56) References Cited

U.S. PATENT DOCUMENTS 1,169,238 A * 1/1916 Clenny ..... 206/427
2,012,131 A * 8/1935 Kondolf ..... B65D 5/4802 206/521.1
2,547,005 A * 4/1951 Huntting ..... B65D 5/566 206/521
2,828,902 A * 4/1958 Ringler ..... B65D 5/5016 206/583
2,857,091 A * 10/1958 Enzie ..... B65D 5/0227 229/132
3,094,266 A * 6/1963 Hoff ..... B31F 1/2822 229/199
3,342,400 A * 9/1967 Kelley ..... B65D 5/563 229/915
4,059,220 A * 11/1977 Lorenz ..... B65D 5/22 229/199
4,441,626 A * 4/1984 Hall ..... B31F 1/2813 426/118
5,568,877 A * 10/1996 Rench ..... B32B 3/16 229/940
7,464,855 B2 * 12/2008 Glasgow ..... B65D 5/6626 229/906
8,307,984 B1 * 11/2012 Collier ..... B65D 81/05 229/87.02

(Continued)

FOREIGN PATENT DOCUMENTS

DE 102015001285 B4 9/2018
EP 1 985 545 A2 10/2008

*Primary Examiner* — Nathan J Newhouse
*Assistant Examiner* — Phillip D Schmidt
(74) *Attorney, Agent, or Firm* — Klarquist Sparkman, LLP

(57) ABSTRACT

A corrugated fiberboard blank has a first section that forms a container and a second section that is receivable within the formed container. The first section can be singlewall board and the second section can be singleface board that is hingedly coupled to the first section such that the second section can be received within the first section when the first section forms the container.

16 Claims, 6 Drawing Sheets

(56) References Cited

U.S. PATENT DOCUMENTS

| | | | | |
|---|---|---|---|---|
| 8,770,466 | B1 * | 7/2014 | Terlesky | B65D 5/48018 229/125 |
| 9,932,162 | B2 | 4/2018 | Stack, Jr. | |

* cited by examiner

SINGLE-PIECE PACKAGE TO CONTAIN AND PROTECT PRODUCT

CROSS REFERENCE TO RELATED APPLICATION

This application claims the benefit of U.S. Provisional Application No. 63/023,161, filed May 11, 2020, which is incorporated herein by reference in its entirety.

FIELD

This disclosure relates generally to containers, including containers for use as delivery and display packages, and methods of manufacturing such containers.

BACKGROUND

Containers often require packaging materials to protect items that are being shipped. Improvements in such containers, including improvements in containing and protecting items held within the container, are desirable.

SUMMARY

Disclosed herein are various embodiments of containers and methods of constructing the same.

In one embodiment, a corrugated fiberboard blank is provided. The blank comprises a first section and a second section. The first section comprises a singlewall board having a plurality of fold lines, and is foldable from a first configuration that is flat to a second configuration in which the first section forms a container. The second section comprises a singleface board, and the second section is hingedly coupled to the first section such that the second section can be received within the first section when the first section is in the second configuration.

In some implementations, first section of the blanks comprises a bottom section, a top section, a front side wall, a rear side wall, a left side wall, and a right side wall, with the second section being hingedly coupled to the front side wall. In some embodiments, the front side wall comprises at least one fold line that hingedly couples the second section to the front side wall. In other embodiments, the front side wall comprises a first fold line, a second fold line, a first cut line, and, when the second section is received within the first section, a ratio of a height of the second section within the container relative to a height of the front side wall ranges from 0.2 to 0.8. In other embodiments, the ratio of a height of the second section within the container relative to a height of the front side wall ranges from 0.2 to 0.5, or from 0.3 to 0.6.

In some implementations, the second section comprises at least one internal opening that can receive an item and/or the second section has a width that is greater than a width of the bottom section.

The singleface board can have a fluted side and a linerboard side, and the fluted side can be on the same side as a top surface of the bottom section, or on the same side as a bottom surface of the bottom section. In some implementations, the top surface of the bottom section comprises a white linerboard, and/or the bottom surface of the bottom section comprises a white linerboard.

In some implementations, the second section comprises one or more fold lines. The one or more fold lines can be positioned to allow the second section to form a rectangular (or other) shape within the container.

In another embodiment, a method of forming a corrugated fiberboard blank is provided. The method can include forming a first section that comprises a singlewall board having a plurality of fold lines and forming a second section comprising a singleface board. The first section is foldable from a first configuration that is flat to a second configuration in which the first section forms a container, and the second section is hingedly coupled to the first section such that the second section can be received within the first section when the first section is in the second configuration.

In some implementations, the method of forming the first section comprises forming the plurality of fold lines to provide a container with a bottom section, a top section, a front side wall, a rear side wall, a left side wall, and a right side wall. The second section can be hingedly coupled to the front side wall.

In other implementations, the method of forming the first section and second section comprises forming a singleface board section and attaching a linerboard to only a portion of the singleface board section to form the first section and the second section. The second section is formed from the portion of the singleface board section that does not receive the linerboard.

In other implementations, the method can include forming an internal opening in the second section. At least one least one fold line can be formed that hingedly couples the second section to the first section. The method can also include forming the front side wall with a first fold line, a second fold line, a first cut line, and a second cut line, such that when the second section is received within the first section, a ratio of a height of the second section within the container relative to a height of the front side wall ranges from 0.2 to 0.8.

The foregoing and other objects, features, and advantages of the invention will become more apparent from the following detailed description, which proceeds with reference to the accompanying figures.

DETAILED DESCRIPTION

Figure 1:
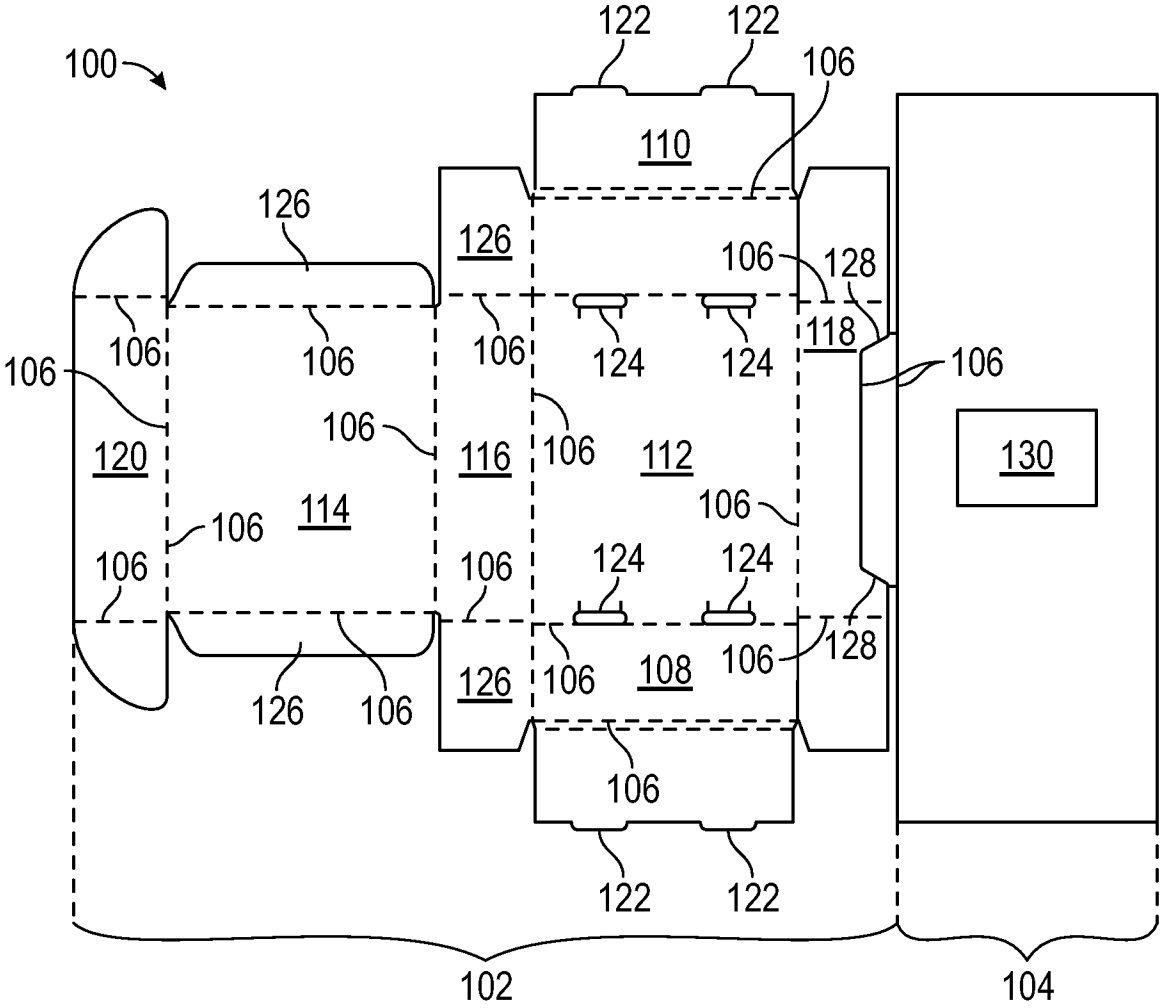
FIG. 1 illustrates a first side of an exemplary blank for constructing a container.

The detailed descriptions herein describe certain exemplary embodiments relating to containers and the construction of such containers.

General Considerations

As used in this application the singular forms "a," "an," and "the" include the plural forms unless the context clearly dictates otherwise. Additionally, the term "includes" means "comprises." Furthermore, as used herein, the term "and/or" means any one item or combination of items in the phrase. In addition, the term "exemplary" means serving as a non-limiting example, instance, or illustration. As used herein, the terms "e.g.," and "for example," introduce a list of one or more non-limiting embodiments, examples, instances, and/or illustrations.

Although the operations of some of the disclosed methods are described in a particular, sequential order for convenient presentation, it should be understood that this manner of description encompasses rearrangement, unless a particular ordering is required by specific language set forth below. For example, operations described sequentially may in some cases be rearranged or performed concurrently. Moreover, for the sake of simplicity, the attached figures may not show the various ways in which the disclosed things and methods can be used in conjunction with other things and methods. Additionally, the description sometimes uses terms like "provide," "produce," "determine," and "select" to describe the disclosed methods. These terms are high-level descriptions of the actual operations that are performed. The actual operations that correspond to these terms will vary depending on the particular implementation and are readily discernible by one of ordinary skill in the art having the benefit of this disclosure.

As used herein, the term "container" refers to an article that is capable of holding one or more products or other physical articles. As used herein, the term "corrugated paperboard box" refers to a box formed from any of a variety of heavy paper-like materials, including, for example, cardstock, corrugated fiberboard, and/or paperboard.

As used herein, the term "blank" refers to a flat sheet of material that is formed into a container, such as a flat sheet of corrugated paperboard. As used herein, "corrugated fiberboard" refers to a material having a fluted corrugated sheet and one or two flat linerboards. The linerboards described herein can be made of a variety of materials and can have any desirable color or construction. For example, linerboards can have, without limitation and in whole or in part, a construction that includes an inside and/or outside face that is white, kraft, mottled, colored, and/or preprinted with a graphic or other desired surface ornamentation.

As used herein, a "singleface board" is a blank, or portion thereof, that is formed with a fluted corrugated sheet and a flat linerboard on one side only. As used herein, a "singlewall board" is a blank, or portion thereof, that is formed with a fluted corrugated sheet and two flat liner boards, one on each side of the corrugated sheet.

As used herein, the term "flat-formed" refers to an article that is manufactured from one or more flat pieces, such as a blank, that are manipulated into a different shape, such as by folding. As used herein, the term "hingedly coupled" refers to any manner of engagement between a first part of a blank relative to a second part of the blank which allows the first part to travel relative to the second part without the first part becoming disengaged from the second part, such as by one or more fold lines, one or more cut lines, and/or some combination thereof.

As used herein, the term "fold lines" refers to any creasing, perforations, or the like that facilitates folding of a wall or other portion of a blank, including, for example, one or more perforations, slit-scores, slit/crease combinations, curved scores, wide-crush zones, embossing, and/or any combination of the same. As used herein, the term "cut line" refers to type of fold line in which an area that includes a cut that extends at least partially through the blank to facilitate folding, tearing, and/or some other structural advantage. Cut lines can be straight, curved, or some other shape, and can include perforation lines in which the cut is not continuous along the length of the cut line (i.e., a perforated line is a cut line that is discontinuous).

As used herein, the terms "graphic" and "graphical element" refer to any visual design elements including, but not limited to, photos, logos, text, illustrations, instructions, advertisements, lines, shapes, patterns, and/or images of various kinds, as well as any combinations of these elements. The terms graphic and graphical element are not intended to be limiting and can incorporate any number of contiguous or non-contiguous visual features. A graphic can be applied to a surface of a material, such as a blank, in any suitable manner. For example, a graphic can be provided on a surface by printing, lamination, adhesive application, coating application (e.g., paint), embossing, and/or any other means.

For the purposes of this disclosure, relative terms such as "vertical", "horizontal", "top", "bottom", "front", "back", "end" and "sides" may be used. It should be understood, however, that the terms are used only for purposes of description, and are not intended to be used as limitations. Accordingly, the orientation of an object or a combination of objects may change without altering the scope of the invention.

Exemplary Containers and Methods of Constructing the Same

Figure 2:
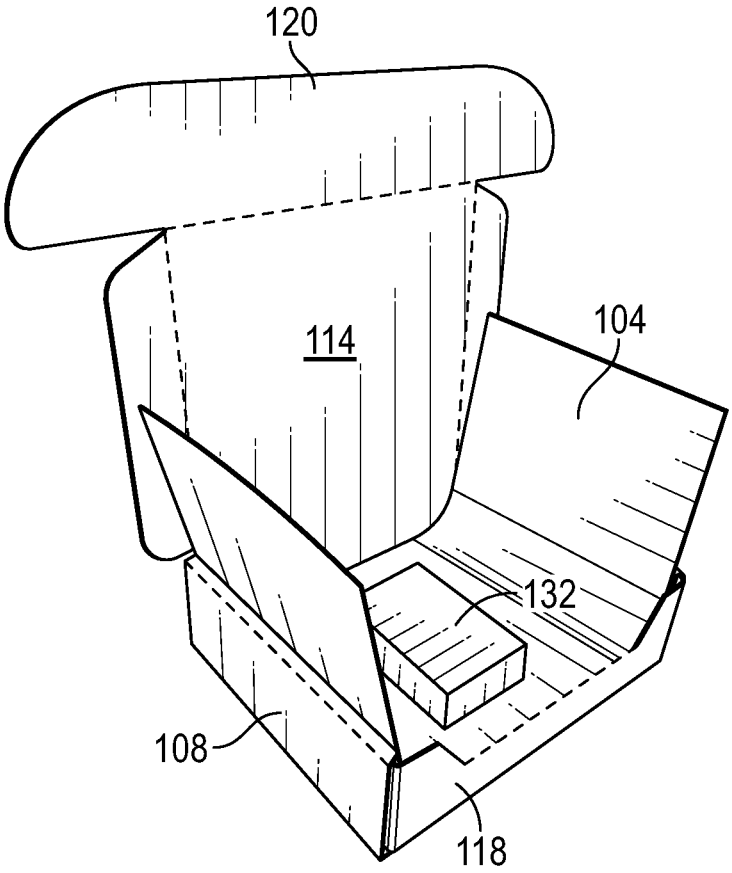
FIG. 2 illustrates an exemplary container formed from a first section of a blank and having a second section of a blank that can be received within the first section.

FIGS. 1 and 2 illustrates an exemplary embodiment of a blank 100 that can be formed into a container, such as a corrugated paperboard box. FIG. 1 illustrates a first side of the blank (i.e., a top side), with the second side (i.e., a bottom side) facing down. First section 102 of the blank 100 is configured to form the container (e.g., a box), while second section 104 is an extending section that can be received within the container to at least partially surround one or more items received within the container (e.g., one or more shipped product(s)).

First section 102 forms a container and can be formed from any suitable material for forming the container, such as a singlewall board. Second section 104 is formed from a different type of material from first section 102. In one embodiment, first section 102 comprises singlewall board and second section 104 comprises singleface board. The singleface board of the second section 104 has a fluted side and a linerboard side. In the illustrated blank of FIG. 1, the fluted side is the top side and the linerboard side is the bottom side.

As shown in FIGS. 1 and 2, the first section 102 can comprise a plurality of fold lines 106 to facilitate folding portions of the first section 102 into the shape of the container (e.g., box). Fold lines 106 can be single fold lines or double fold lines (e.g., substantially parallel fold lines), such as the fold lines at the left side wall 108 and right side wall 110.

In the exemplary embodiment of FIG. 1, the container is formed from bottom section 112, left and right side walls 108, 110, top section 114, rear side wall 116, front side wall 118, and front closure wall 120. In constructing the container, the left and right side walls 108, 110 fold to form a double wall with tab portions 122 extending into corresponding openings 124 in the bottom section 112. Wing portions 126 of rear side wall 116 and top section 114 are folded and positioned adjacent respective ones of the left and right side walls 108, 110. To close the box, front closure wall 120 folds over and the wing portions of front closure wall 120 are folded to extend into slots formed in the double wall portions of side walls 108, 110.

As discussed above, blank 100 comprises a second section 104 that can be received inside the container. As shown in FIG. 1, the front side wall 118 can have at least one fold line that hingedly couples the second section 104 to the front side wall 118.

In one embodiment, a fold line can be provided at the intersection of the front side wall 118 and second section 104 (e.g., the fold line 106 at the intersection in FIG. 1). A single fold line would permit the second section 104 to fold back into the container.

Alternatively, at least two fold lines can be provided to allow the second section to enter the interior volume of the container at a height below that of the upper edge of front side wall 118. In some embodiments, one or more cut lines can facilitate this arrangement as discussed below.

In the embodiment of FIGS. 1 and 2, the top side of section 104 (visible side in FIG. 1) comprises singleface board with the fluted side facing up. As shown in FIG. 2, once the container is constructed the second section is folded over at the adjacent fold lines 106 and positioned within the container. One or more cut lines 128 are provided to facilitate the movement of the second section into the container.

In one embodiment, the second section 104 can comprise one or more cut outs for receiving correspondingly shaped products. For example, second section 104 has an opening 130 in FIG. 1. As shown in FIG. 2, opening 130 can be sized so that when the second section 104 is positioned within the opening, a product 132 can be received within opening 130.

The height at which the second section 104 is positioned within the container can vary depending on the selected location of the fold lines adjacent the second section 104. In some embodiments, the fold lines can be selected so that the second section 104 can contact the bottom section. For example, the lower fold line 106 can be positioned at a midpoint between the bottom and top of the front side wall 118 (with the cut lines similarly extended). This would result in the second section 104 being foldable into the container with a surface of the second section 104 in contact with, or adjacent to, the bottom section 112. In other embodiments, the fold lines can be positioned at a top portion of the front side wall 118 so that the second section 104 is foldable into the container with a surface of the second section 104 in contact with or adjacent a top section 114.

Alternatively, the fold lines and cut lines can be selected so that the second section 104, when received in the container, has at least a portion that is at a height above the bottom section 112 and below the top section 114. For example, a ratio of the height of the second section 104 within the container (as measured at the location of the fold lines) relative to the height of the front side wall 118 can be from 0.2 to 0.8. In some embodiments, the ratio can be 0.2 to 0.5, or from 0.3 to 0.6.

If the height of the second section varies at the location where the second section 104 enters the container (e.g., at a fold line), then the height should be calculated as an average height for the purposes of the ratios described herein. In addition, it should be noted that the second section 104 may not enter the container at a 90 degree angle, but at some other angle relative to front side wall 118. In such cases, the height can still be measured at the location of entry along the side wall 118.

In other embodiments, the height of the second section 104 within the container can be selected based on the height of the product 132 to be received within the container. Thus, for example, a ratio of the height of the second section 104 within the container can be, relative to the height of the product 132, from 0.2 to 0.8, 0.3 to 0.7, or about 0.5. In each case, by providing an opening 130 and positioning the second section 104 within the container at a raised height (relative to the bottom section), the second section 104 can engage the product and restrict movement of the product within the container.

It should be noted, however, that even if the second section 104 lays flat on the bottom section 112, the opening 130 in the second section 104 can still function to secure the product 132 since the second section 104 itself has a thickness relative to the product.

Thus, the fold lines can be positioned so that the second section 104, which is hingedly coupled to the front side wall 118, can fold into the container at any desired height relative to a height of the front side wall 118 and/or the product(s) 132.

As shown in FIG. 1, the second section 104 can be wider than a width of the bottom section 112 of the container. Because singleface board is significantly more flexible than singlewall board, the second section 104 can be manipulated into a desired shape within the container.

Figure 3:
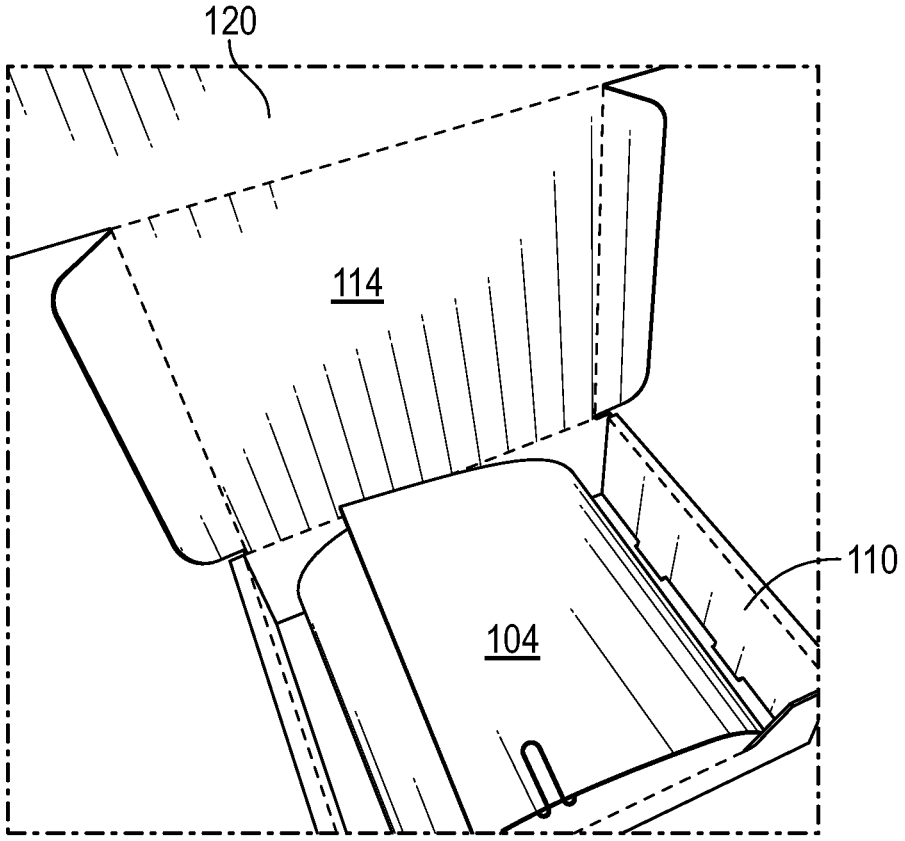
FIG. 3 illustrates the exemplary container of FIG. 2 with the second section of the blank received within the first section.

If the second section 104 is wider than a width of the bottom section 112, as is shown in FIG. 1, then the second section 104 can also be used to at least partially surround a product positioned within the container. For example, as shown in FIG. 3, the product is at least partially surrounded by the second section, with the linerboard side facing the product and the fluted side facing out. In some embodiments, the second section 104 can entirely surround the product (e.g., left and right side edges of the second section 104 can overlap to entirely surround the product). In other embodiments, a width of the second section can be sized to extend over only a portion of the product, with a gap formed between the left and right side edges of the second section 104 so that the product is at least partially exposed between the edges of the second section 104.

One or more closure mechanisms can be provided for securing the second section 104 when it at least partially surrounds the product. The closure mechanism can be separate from the second section 104 or integrally formed with the second section. For example, it can comprise a clipping device, a tying mechanism, or one or more engaging notches or tabs in the second section 104 that can engage with one another to provide a closure.

As discussed above, one or more openings 130 can help to secure a product(s) within the container. However, in other embodiments, no opening is required and second section 104 can simply wrap the product to secure it. For example, As shown in FIG. 3, the second section 104 can be sized and/or secured so that the product is securely held and protected within only a portion of the container.

In some embodiments, the blank 100 can have a graphic side and a non-graphic side. Printing graphics on both sides of a container generally requires one printing pass for each side, which can make it more economical to print on one side only. In some embodiments, the graphic side can be a kraft liner side that receives printing. Alternatively, the graphic side can be a white liner, or other color liner.

FIGS. 1-3 illustrate the construction of a container formed from blank 100 with a graphic side (e.g., white liner side) on the outside of the container (i.e., the bottom side of FIG. 1). As illustrated in these figures, graphics can be printed on the white liner side so that the outside of the container is branded and/or more aesthetically pleasing. In this embodiment, graphics can also be provided on the linerboard side of the second section 104. Thus, as the box and the second section 104 are opened, the internal graphics of the second section 104 are revealed (see, e.g., FIG. 2).

Figure 4:
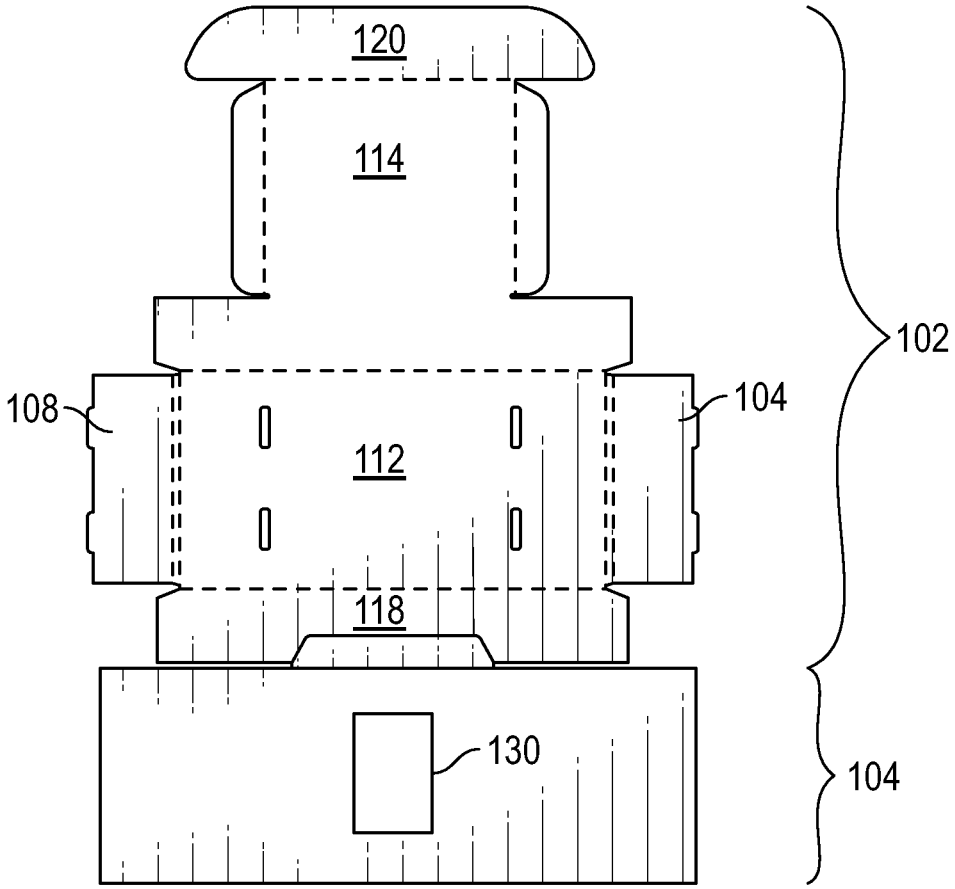
FIG. 4 illustrates a blank for forming an exemplary container from a first section of the blank.
Figure 5:
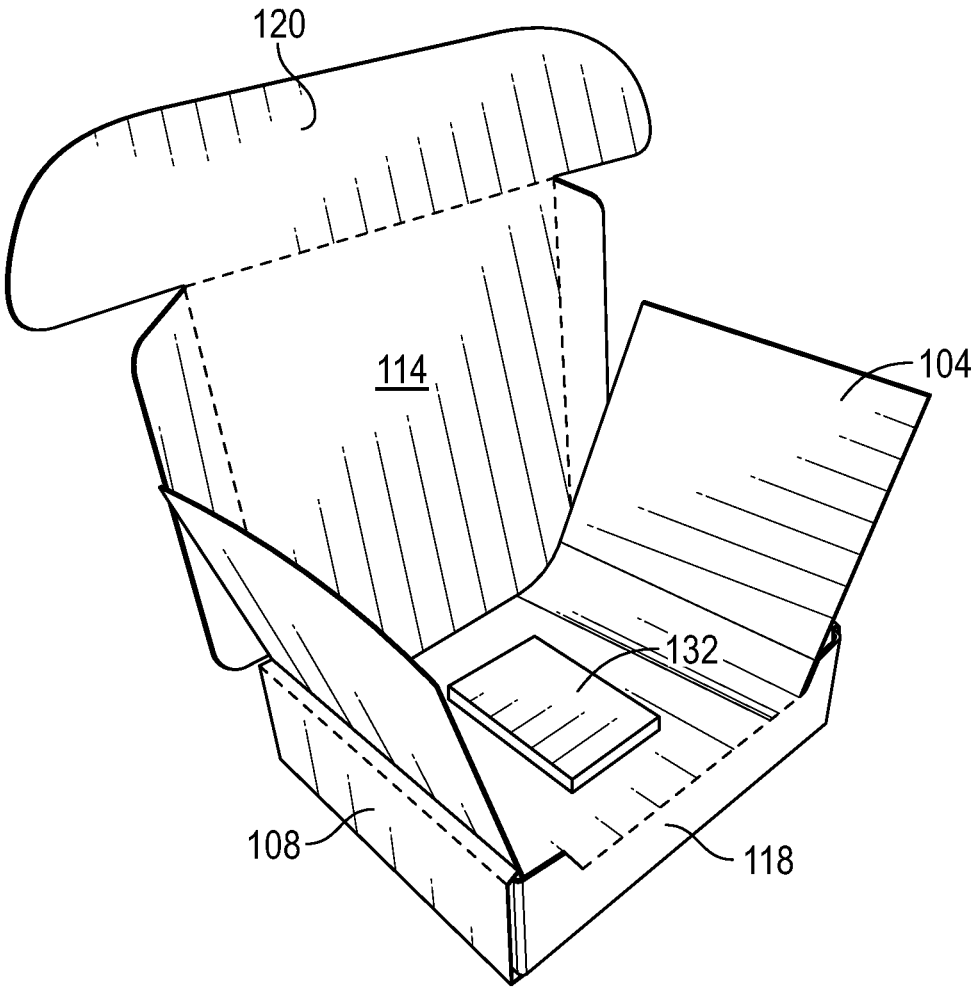
FIG. 5 illustrates the exemplary container of FIG. 4 with a second section of the blank received within the first section.

Alternatively, a graphic side can be provided on the inside of the box. FIGS. 4 and 5 illustrate an embodiment where a white liner is positioned on the inside of the box, with a kraft liner on the outside. This can allow for additional graphics to be exposed as the box is opened.

As shown in FIG. 2, the second section 104 can be provided so that the linerboard side faces the product when the product is at least partially surrounded by the second section. Alternatively, the fluted side can be positioned on the other side, so that the fluted side faces the product. In some cases, it may be desirable to provide the fluted side facing the product for greater impact protection.

Figure 6:
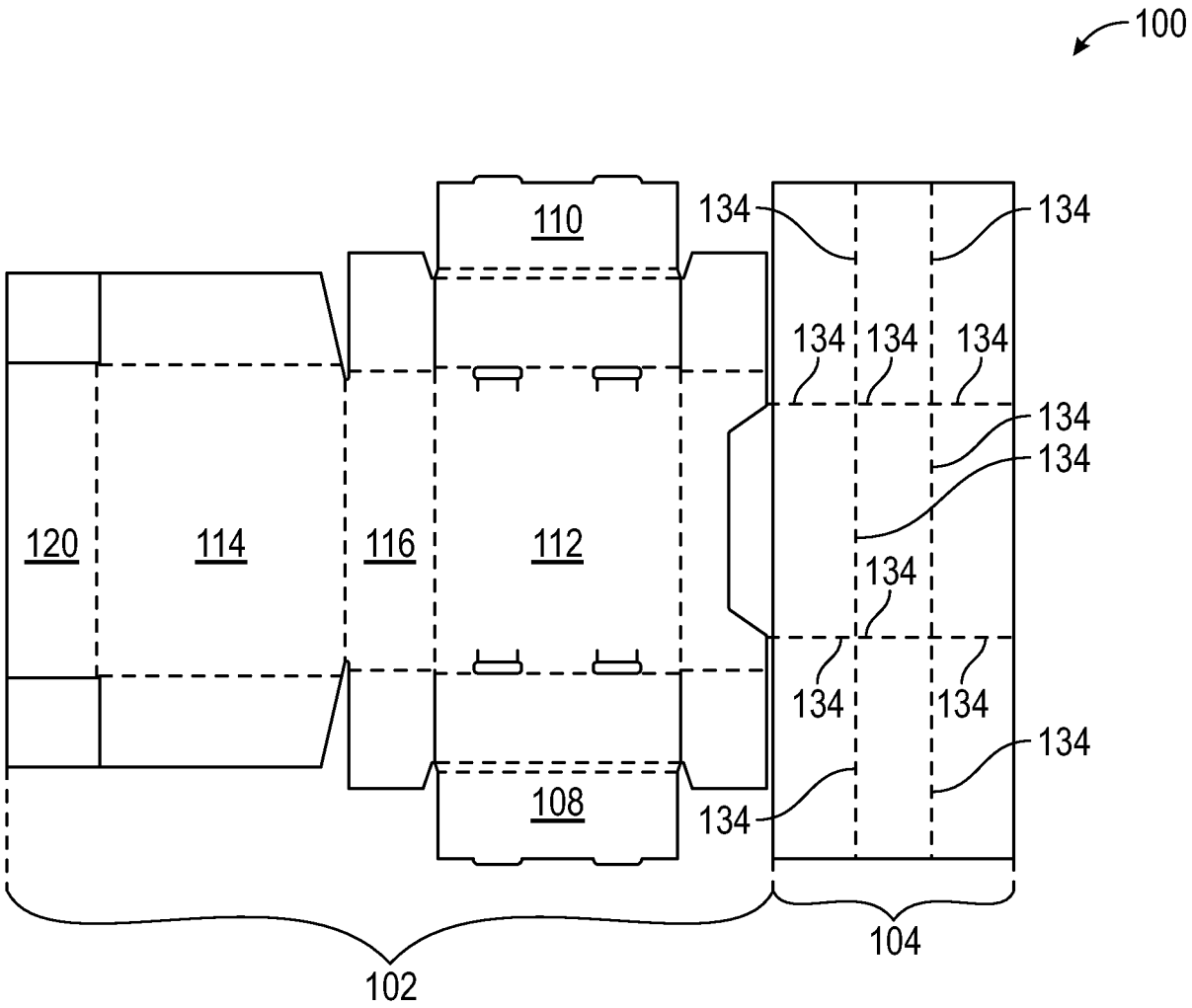
FIG. 6 illustrates a first side of another exemplary blank for constructing a container.

FIG. 6 illustrates another embodiment of a blank that can be formed with a first section 102 that comprises a singlewall board and second section 104 that comprises a singleface board.

In the embodiment shown in FIG. 6, additional fold lines 134 are provided in the second section 104 to allow for a variety of shapes to be created with the second section 104. Thus, for example, the second section 104 can be folded over on itself, in one or more directions, to provide a double walled portion at least partially surrounding a product. Alternatively, the fold lines 134 can permit the second section 104 to form a rectangular or other shape as it surrounds (or partially surrounds) a product.

The blanks disclosed herein can be produced using a variety of manufacturing methods. In one embodiment, a blank with the first section (singlewall board) and second section (singleface board) can be formed by producing a full-width singleface board (i.e., a singleface board with a full-width inside liner and a full-width corrugating medium). A conventional corrugator can be provided to laminate a narrower-width outside liner to the full-width singleface board, such as by applying starch only to the appropriate width/portion of the singleface board. The resulting blank has a first section that is a singlewall board and a second section that is a singleface board.

In another embodiment, a singleface laminator can be used to provide a full-width singleface board to which a narrower outside liner can be applied to provide a first section that is a singlewall board and a second section that is a singleface board.

The containers described herein can be used for various purposes, including shipping products. For shipping purposes, such as shipping to a consumer, the advantages include securing and protecting the one or more product(s) received in the container. Various size openings can be provided, as desired. In addition, the singleface board is highly customizable to accommodate various size and shape products simply altering the size of the singleface board and/or the location/amount of fold lines. The novel blanks and containers described herein can also provide a more sustainable packaging solution to many of the current plastic- or foam-based packing solutions commonly used today. Finally, wrapping a product with the singleface board can also provide an improved user experience (i.e., the "unboxing" experience) by providing an elegant, yet simple, packaging appearance upon arrive to the customer. The containers disclosed herein can also be for e-Commerce subscription services in which the unboxing experience may be particularly desirable for consumers.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. I therefore claim as my invention all that comes within the scope and spirit of these claims.

I claim:

1. A corrugated fiberboard blank comprising:

a first section that comprises a singlewall board having a plurality of fold lines, the first section being foldable from a first configuration that is flat to a second configuration in which the first section forms a container; and a second section comprising a singleface board and having a left side and a right side;

wherein the second section is hingedly coupled to the first section such that the second section can be received within the first section when the first section is in the second configuration with the left side and right side of the second section at least partially overlapping, wherein the first section comprises:

a bottom section;

a top section;

a front side wall;

a rear side wall;

a left side wall; and a right side wall;

wherein the second section is hingedly coupled to the front side wall, wherein the front side wall comprises a first fold line, a second fold line, a first cut line, and wherein, when the second section is received within the first section, a ratio of a height of the second section within the container relative to a height of the front side wall ranges from 0.2 to 0.8.

2. The corrugated fiberboard blank of claim 1, wherein the front side wall comprises at least one fold line that hingedly couples the second section to the front side wall.

3. The corrugated fiberboard blank of claim 1, wherein, when the second section is received within the first section, the ratio of a height of the second section within the container relative to a height of the front side wall ranges from 0.2 to 0.5.

4. The corrugated fiberboard blank of claim 1, wherein, when the second section is received within the first section, the ratio of a height of the second section within the container relative to a height of the front side wall ranges from 0.3 to 0.6.

5. The corrugated fiberboard blank of claim 1, wherein the second section comprises at least one internal opening that can receive an item.

6. The corrugated fiberboard blank of claim 1, wherein the second section has a width that is greater than a width of the bottom section.

7. The corrugated fiberboard blank of claim 1, wherein the singleface board comprises a fluted side and a linerboard side, and wherein the fluted side is on the same side as a top surface of the bottom section.

8. The corrugated fiberboard blank of claim 1, wherein a top surface of the bottom section comprises a white linerboard.

9. The corrugated fiberboard blank of claim 1, wherein a bottom surface of the bottom section comprises a white linerboard.

10. The corrugated fiberboard blank of claim 1, wherein the second section comprises one or more fold lines.

11. The corrugated fiberboard blank of claim 10, wherein the one or more fold lines are positioned to allow the second section to form a rectangular shape within the container.

12. A corrugated fiberboard blank comprising:

a first section that comprises a singlewall board having a plurality of fold lines, the first section being foldable from a first configuration that is flat to a second configuration in which the first section forms a container; and a second section comprising a singleface board and having a left side and a right side;

wherein the second section is hingedly coupled to the first section such that the second section can be received within the first section when the first section is in the second configuration with the left side and right side of the second section at least partially overlapping, wherein the first section comprises:

a bottom section;

a top section;

a front side wall;

a rear side wall;

a left side wall; and a right side wall;

wherein the second section is hingedly coupled to the front side wall, and wherein the singleface board comprises a fluted side and a linerboard side, and wherein the fluted side is on the same side as a bottom surface of the bottom section.

13. A method of forming a corrugated fiberboard blank comprising:

forming a first section that comprises a singlewall board having a plurality of fold lines, the first section being foldable from a first configuration that is flat to a second configuration in which the first section forms a container; and forming a second section comprising a singleface board having a left side and a right side;

forming the plurality of fold lines to provide a container with a bottom section, a top section, a front side wall, a rear side wall, a left side wall, and a right side wall; and forming the front side wall with a first fold line, a second fold line, a first cut line, and a second cut line;

wherein the second section is hingedly coupled to the first section such that the second section can be received within the first section when the first section is in the second configuration with the left side and right side of the second section at least partially overlapping, wherein the second section is hingedly coupled to the front side wall, and wherein, when the second section is received within the first section, a ratio of a height of the second section within the container relative to a height of the front side wall ranges from 0.2 to 0.8.

14. The method of claim 13, wherein the method of forming the first section and second section comprises:

forming a singleface board section and attaching a linerboard to only a portion of the singleface board section to form the first section and the second section, wherein the second section is formed from the portion of the singleface board section that does not receive the linerboard.

15. The method of claim 13, further comprising:

forming an internal opening in the second section.

16. The method of claim 13, further comprising:

forming at least one least one fold line that hingedly couples the second section to the first section.

* * * * *